US005230324A

United States Patent [19]

Van Horssen et al.

[11] Patent Number: 5,230,324

[45] Date of Patent: Jul. 27, 1993

[54] GAS POWERED WEAPON HAVING SHEARABLE DIAPHRAGM MEMBER

[76] Inventors: Arden D. Van Horssen, 13110 Serenade Cir., Sun City West, Ariz. 85375; Charles A. Van Horssen, 9233 N. 12th Ave., Phoenix, Ariz. 85021

[21] Appl. No.: 770,920

[22] Filed: Oct. 4, 1991

[51] Int. Cl.[5] ..... F41B 11/06

[52] U.S. Cl. ..... 124/61; 124/71; 124/74; 124/76

[58] Field of Search ..... 124/61, 71, 73, 74, 124/75, 76, 37, 35.2, 56

[56] References Cited

U.S. PATENT DOCUMENTS

| | | | |
|---|---|---|---|
| 556,058 | 3/1896 | Huey | 124/71 |
| 3,103,212 | 9/1963 | Merz | 124/76 |
| 3,119,384 | 1/1964 | Merz | 124/74 X |
| 3,227,148 | 1/1966 | Spack | 124/74 X |
| 3,422,808 | 1/1969 | Stein et al. | 124/61 |
| 3,428,037 | 2/1969 | Capriolo et al. | 124/61 |

FOREIGN PATENT DOCUMENTS

| | | | |
|---|---|---|---|
| 2730125 | 1/1979 | Fed. Rep. of Germany | 124/74 |
| 166658 | 3/1959 | Sweden | 124/71 |

*Primary Examiner*—Dennis L. Taylor
*Assistant Examiner*—Jeffrey L. Thompson
*Attorney, Agent, or Firm*—Tod R. Nissle

[57] ABSTRACT

A weapon system which utilizes pressurized gas to propel a projectile from a barrel and which utilizes a shearable diaphragm member to permit the pressure of gas in the weapon to increase to a selected point before the gas propels the projectile from the barrel.

4 Claims, 6 Drawing Sheets

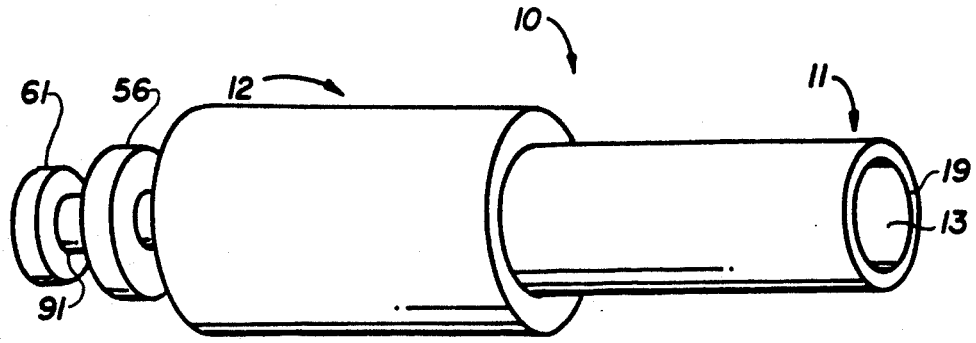
FIG. 1
FIG. 7
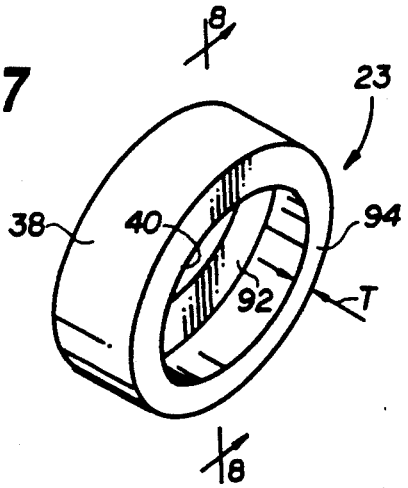
FIG. 8
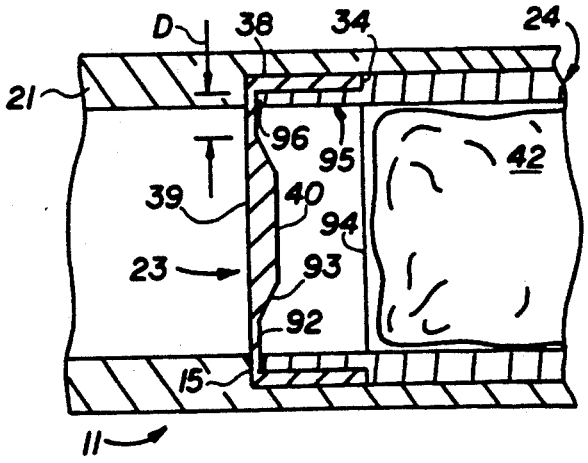
FIG. 9
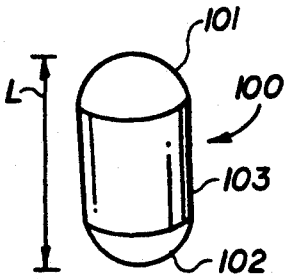

GAS POWERED WEAPON HAVING SHEARABLE DIAPHRAGM MEMBER

This invention relates to weapon systems.

More particularly, the invention relates to a weapon system which utilizes pressurized gas to propel a projectile from a barrel and which utilizes a shearable diaphragm member to permit the pressure of gas in the weapon to increase to a selected point before the gas propels the projectile from the barrel.

In a further respect, the invention relates to a weapon which displaces a spherical member to activate a trigger mechanism and cause the weapon to fire.

Gas powered weapon systems are well known in the art. See, for example, U.S. Pat. No. 3,889,652 to Curtis. The weapon described in the Curtis patent fires a projectile which is, when the projectile is in the barrel of the weapon, bracketed on either side by a pair of gas check members 96 and 102 which are illustrated in FIG. 4 of the Curtis patent. The gas check members 96 and 102 slide along barrel 20 with the projectile 100 when the weapon is fired. One disadvantage of the weapon described in the Curtis patent is that the velocity of the projectile as it leaves the weapon is adjusted by varying the size of the gas cartridge used in the weapon. Consequently, in the Curtis weapon, one size cartridge is utilized to provide a weapon which fires a "low energy" projectile, a larger cartridge is utilized to provide a weapon which fires a "medium energy" projectile, and a still larger cartridge (consisting of a pair of pressurized gas containers) is utilized to provide a weapon which fires a "high energy" projectile. Manufacturing these different sized cartridges and the weapons adapted to fit the different sized cartridges is expensive and impractical. Another disadvantage of the Curtis weapon is that it must be cocked after it is assembled. Since the user of the weapon likely will not remember whether the weapon is cocked, or will forget to cock the weapon, in an emergency a split second will ordinarily pass before the user determines the weapon is cocked and then makes a decision to fire the weapon. If the Curtis weapon cocked automatically on being assembled this problem would be eliminated. Still another disadvantage of the Curtis weapon is that the trigger or operating knob 48 can, in an emergency, be difficult to locate and use.

Accordingly, it would be highly desirable to provide an improved gas powered weapon which permitted the velocity of the projectile fired by the weapon to be readily adjusted without requiring the use of different sized containers of pressurized gas, which would cock automatically on assembly, and which enabled the user to readily locate and activate the firing mechanism in event of an emergency.

Therefore, it is a principal object of the invention to provide an improved weapon.

A further object of the invention is to provide an improved gas powered weapon of the type including a pressurized gas container which is discharged to produce the pressure necessary to propel a projectile from the weapon.

Another object of the invention is to provide an improved gas powered weapon of the type described which permits ready adjustment of the velocity of the projectile while using a pressurized gas container that has a fixed size and that stores gas at a selected pressure.

Still a further object of the invention is to provide an improved gas powered weapon of the type described which cocks automatically on assembly.

Yet another object of the invention is to provide an improved gas powered weapon of the type described which enables a user to readily locate and activate the firing mechanism of the weapon.

These and other, further and more specific objects and advantages of the invention will be apparent to those skilled in the art from the following detailed description thereof, taken in conjunction with the drawings, in which:

FIG. 1 is a perspective view of a gas powered weapon constructed in accordance with the principles of the invention;

FIG. 7 is a perspective view of a shearable diaphragm utilized in the weapon of FIG. 1;

FIG. 8 is a side section of view of the diaphragm of FIG. 7 taken along section line 8—8 thereof; and, FIG. 9 is a perspective view of a ball used in the practice of the invention.

Figure 2:
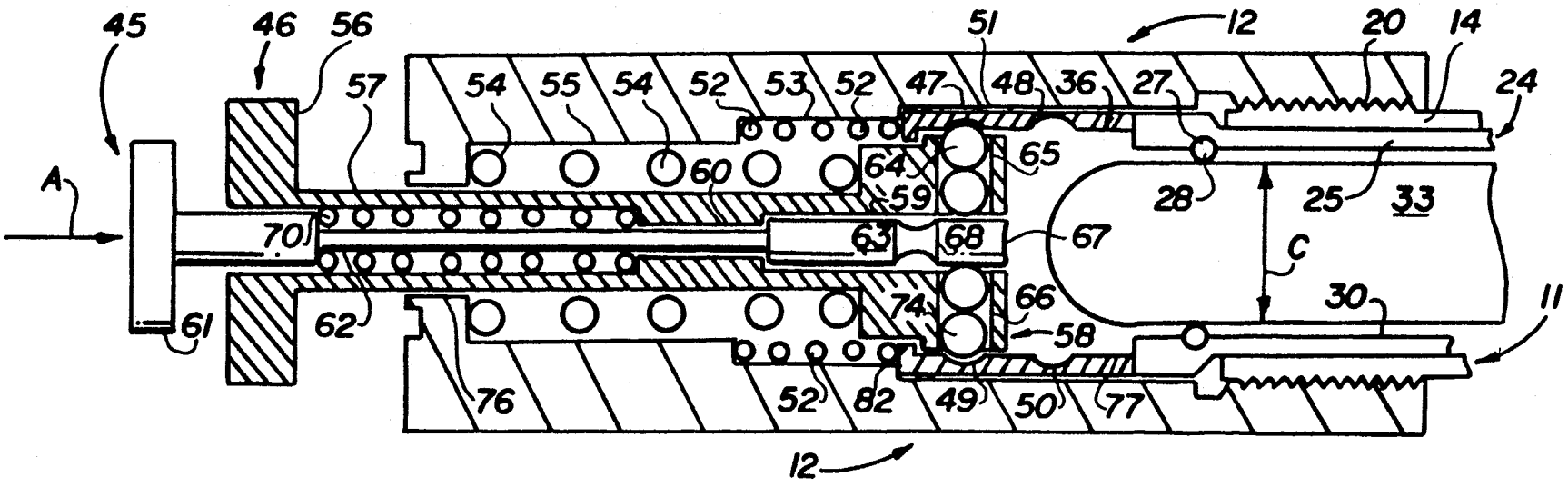
FIG. 2 is a side section view of the rear portion of the weapon of FIG. 1 illustrating the firing mechanism thereof.

Briefly, in accordance with our invention, we provide a gas powered weapon system. The system includes a case defining first and second axially extending passages, said first passage being in fluid communication with said second passage and having an open end; a projectile located in said first passage to be slidably urged along the first passage and out the open end; a dischargeable pressurized gas container located in the second passage; a transversely extending shearable member located in one of the first and second passages intermediate the gas container and the open end; and, means for releasing the pressurized gas from the gas container to increase the pressure inside the case, cause the member to shear, and cause at least a portion of the gas to move from the second passage to the first passage and propel the projectile through the first passage and out the open end. The means for releasing the pressurized gas can include means for displacing the gas container. The displacing means can include a housing positioned in the second passage and having a first axial passage extending through the housing, a second radial passage extending through the housing, and ball means slidably positioned in the radial passage; spring means positioned in the second passage to urge the housing toward the gas container; control means positioned in the second passage and having first and second spaced apart grooves each for receiving in part the ball means; and, plunger means including a groove for receiving in part the ball means and slidably positioned in the first axial passage for movement between at least two operative positions, a first position with the plunger means urging the ball means into contact with the first groove of the control means, and a second operative position with the plunger means axially displaced from the first position to permit the ball means to move radially out of contact with the first groove of the control means and into contact with the groove in the plunger means, and the spring means to displace the housing and the plunger means toward the gas container such that at least one of the plunger means and the housing contacts and axially displaces the gas container.

In another embodiment of the invention, we provide a weapon system including a case defining first and second axially extending passages, the first passage being in fluid communication with the second passage and having an open end; a projectile slidably located in the first passage to be slidably urged along the first passage and out the open end; a dischargeable pressurized gas container located in the second passage; means for releasing the pressurized gas from the gas container to increase the pressure inside the case and cause at least a portion of the gas to move from the second passage to the first passage and slidably propel the projectile through the first passage and out the open end. The releasing means includes a housing positioned in the second passage and having a radial passage extending through the housing, and ball means slidably positioned in the radial passage; spring means positioned in the second passage to urge the housing toward the gas container; control means positioned in the second passage and having first and second spaced apart grooves each for receiving in part the ball means; and plunger means including a groove for receiving in part the ball means. The plunger means is moveable between at least two operative positions, a first position with the plunger means urging the ball means into contact with the first groove of the control means, and a second operative position. In the second operative position the plunger means is axially displaced from the first position to permit the ball means to move radially out of contact with the first groove of the control means and into contract with the groove in the plunger means, and to permit the spring means to displace the housing toward the gas container.

Figure 6:
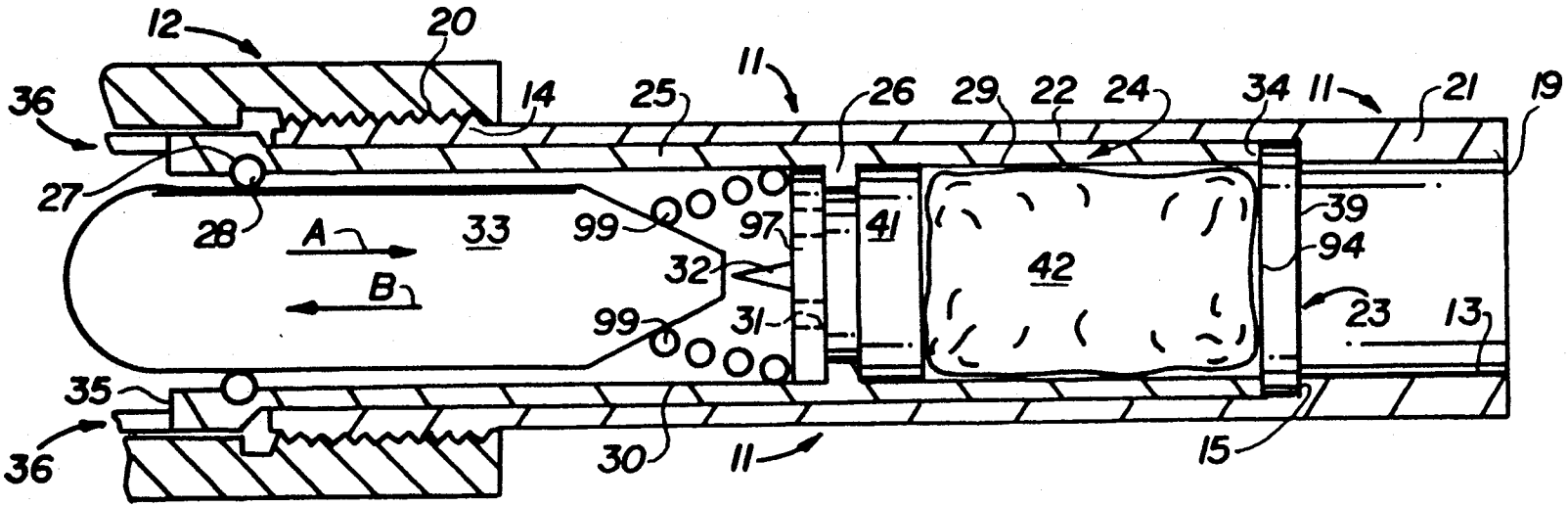
FIG. 6 is a side section view of the forward portion of the weapon of FIG. 1.

Turning now to the drawings, in which the presently preferred embodiments of the invention are shown for the purpose of illustrating the practice thereof and not by way of limitation of the scope of the invention and in which like elements are indicated by corresponding reference characters throughout the several views, FIG. 1 illustrates a weapon constructed in accordance with the principles of the invention and generally indicated by reference character 10. Weapon 10 includes cylindrical hollow barrel 11 and cylindrical hollow casing 12. Head 61 and circular head 56 are, as will be described below, part of the firing mechanism of the weapon 10. As shown in FIG. 6, barrel 10 includes circular open end 19 and inner cylindrical passageway 13. Cylindrical end 14 of barrel 11 is externally threaded. One end of casing 12 includes internally threaded cylindrical surface 20 which turns onto the externally threaded end 14 of barrel 11. Circular ledge 15 in barrel 11 is formed because cylindrical wall 21 of barrel 11 has a greater thickness than cylindrical wall 22 of barrel 11. The inner diameter of wall 21 is less than the inner diameter of wall 22. The outer diameter of wall 21 equals the outer diameter of wall 22. The outer diameter of diaphragm member 23 is approximately equal to the inner diameter of wall 22 of barrel 11.

In FIG. 6, hollow cylindrical shot tube 24 includes wall 25 having an outer diameter which is slightly less than the inner diameter of wall 22 of barrel 11 such that shot tube 24 can be slidably inserted into and removed from cylindrical wall 22 of barrel 11. With the exception of step bore 26 and the circular groove 27 formed for O-ring 28, the inner diameter of shot tube 24 is constant along the length of tube 24. The portion of the inner passageway of shot tube 24 to the right of step bore 26 in FIG. 6 is indicated by reference character 29. The portion of the inner passageway of shot tube 24 to the left of step bore 26 in FIG. 6 is indicated by reference character 30.

The diameter of bore 26 is less than the inner diameter of tube 24. Puncture point 32 outwardly depends from cylindrical member 97. Apertures 31 are formed through member 97 so that gas can flow between inner passageways 29 and 30. O-ring 28 sealingly engages pressurized gas container 33 and prevents gas from escaping therebetween. The circular end 34 of shot tube 24 presses the outer edge of diaphragm member 23 against ledge 15. Circular control or shuttle member 36 presses against circular end 35 of shot tube 24 to force end 34 against diaphragm member 23 in FIG. 6. Conical spring 99 extends from the neck of container 33 to member 97.

Diaphragm member 23 is illustrated in greater detail in FIGS. 7 and 8 and includes cylindrical wall 38 which outwardly depends from conical base 39. Base 39 conically tapers 93 from the center plateau 40 of base 39 outwardly toward circular floor 92 and wall 38. The plastic or other material used to fabricate member 23 has a strength which permits base 39 to be sheared free from wall 38 when the gas in container 33 is released in the manner described below. The thickness of base 39 is less along floor 92 than at the center plateau 40 of base 39 so that the base 39 tends to shear along a circular line at points between circular ledge 15 of barrel 11 and circular end 96 of tube 24. The outer diameter and thickness T of wall 38 are such that when base 39 shears free of wall 38, the portion of base 39 which shears free has a diameter which is approximately equal to the inner diameter of wall 21 of barrel 11.

In FIG. 6, container 33 is illustrated in position prior to the weapon being fired. In FIG. 6, the pressurized gas in container 33 has not yet been released. As will be described, when the weapon 10 is fired, container 33 is moved from its position in FIG. 6 and spring 99 is compressed in the direction of arrow A so that point 32 pierces the seal in the neck of the container. After point 32 punctures the seal in the neck of the container, the firing mechanism of the weapon permits the pressure of gas attempting to escape the container and the expansive pressure of spring 99 to force the container in the direction of arrow B to release gas into passageway 30. Once gas is released into passageway 30, it travels trough apertures 31 and step bore 26 into passage 29 and presses against disk-shaped check member 41 and forces member 41 against projectile 42. Member 41 slides along passageway 29 and presses projectile 42 against diaphragm 23. Once the gas released from container 33 reaches a selected pressure, the force of projectile 42 against diaphragm 23 causes base 39 to shear free from wall 38 so that base 39, projectile 42, and disk member 41 can slide along the cylindrical passageway 29 and the inner cylindrical surface 13 of wall 21 and out the open end 19 of barrel 11.

The trigger mechanism for firing the weapon 10 is illustrated in FIGS. 2 to 5 and includes plunger unit 45, housing 46, and control or shuttle member 36. Circular grooves or dimples 47 to 50 are formed in shuttle member 36. The outer diameter of shuttle member 36 is slightly less than the diameter of inner cylindrical passageway 51 of casing 12 so that member 36 can slide inside passageway 51. The outer diameter of spring 52 is slightly less than the diameter of inner cylindrical passageway 53 so that spring 52 can slide inside of passageway 53. The outer diameter of cylindrical spring 54 is slightly less than the diameter of inner cylindrical passageway 55 so that one end of spring 54 can slide into passageway 55.

Cylindrical housing 46 includes cylindrical head 56 connected to cylindrical throat 57. Throat 57 is connected to cylindrical ball carrier or foot 58. Cylindrical aperture 59 axially extends through a portion of throat 57 and through foot 58. Cylindrical apertures 65 and 66 extend radially through foot 58 from aperture 59 to the outer cylindrical surface of foot 58. Shuttle member 36 includes an inner cylindrical surface 77 in which dimples 47 to 50 are formed. The diameter of cylindrical surface 86 (FIG. 4) of foot 58 is slightly less than the diameter of cylindrical inner surface 77 of member 36 such that surface 86 can slidably move along surface 77. The diameter of outer cylindrical surface 87 (FIG. 4) of foot 58 is slightly less than the diameter of cylindrical inner surface 83 of member 36 such that surface 87 can slidably move through surface 83. A pair of steel spheres 64 are slidably stacked in aperture 65. A second pair of steel spheres 74 are slidably stacked in aperture 66.

Plunger 45 is substantially enclosed and slidably mounted in housing 46. T-shaped cylindrical head 61 of plunger 45 is connected to elongate cylindrical neck or rod 62. Neck 62 interconnects head 61 and elongate cylindrical toe 63. Toe 63 is provided with a circular end contact surface 67 and a groove 68 which circumscribes toe 63. The outer diameter of toe 63 is slightly less than the diameter of aperture 59 such that toe 63 can slidably move through aperture 59. The inner diameter of step bore 60 is less than the outer diameter of toe 63. Bore 60 therefor stops any movement of toe 63 through aperture 59 toward head 56. The diameter of cylindrical portion 91 of head 61 is slightly less than the diameter of aperture 98 (FIG. 3) such that portion 91 can slidably moved through aperture 98. The diameter of neck 62 is slightly less than the diameter of step bore 60 such that neck 62 can slidably move through bore 60.

Figure 5:
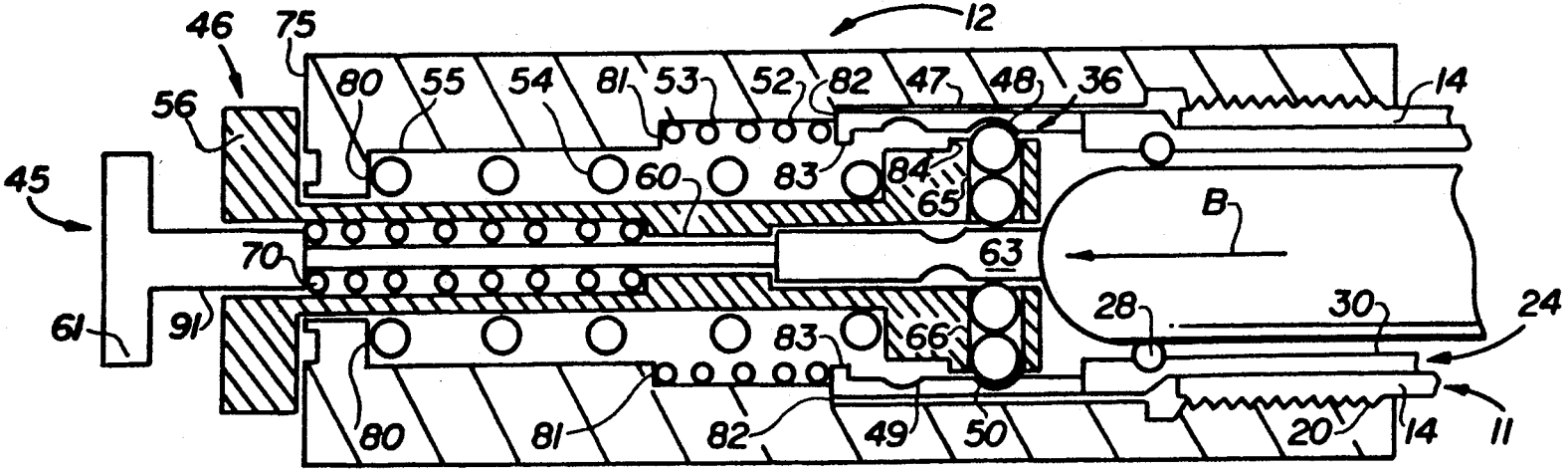
FIG. 5 is a side section view of the rear portion of the weapon of FIG. 1 yet still further illustrating the mode of operation thereof.

As illustrated in FIG. 5, spring 54 is compressed between circular lip 80 and foot 58 of housing 46. Spring 52 is compressed between circular lip 81 and member 36. Spring 70 is compressed between step bore 60 and portion 91 of head 61.

The operation of the trigger mechanism of the weapon of the invention is explained with reference to FIGS. 2 to 6. In FIG. 2, the diameter of pressurized gas container 33 is indicated by arrows C. The diameter of container 33 is less than the diameter of passageway 30 such that container 33 can slidably move through passageway 30.

In FIG. 2, the threads on internal surface 20 of casing 12 have been turned onto the externally threaded end 14 of barrel 11. In FIG. 2, the trigger mechanism is cocked and ready for use. The simple act of threading casing 12 onto end 14 of barrel 11 automatically cocks the trigger mechanism. Exactly how the trigger mechanism cocks itself when casing 12 is threaded onto end 14 is discussed later. In FIG. 2, the outer cylindrical surface of toe 63 forces spheres 64 toward dimple 47 and forces spheres 74 toward dimple 49. Spring 54 forces foot 58 toward container 33. Foot 58 cannot, however, move because one of spheres 64 is forced into dimple 47 and because one of sphere pair 74 is forced into dimple 49. Shuttle member 36 cannot move toward container 33 because member 36 is pressed between end 35 (FIG. 3) of shot tube 24 and circular lip 82. Finally, in FIG. 2, toe 63 is forced against step bore 60 by compressed spring 70.

Figure 3:
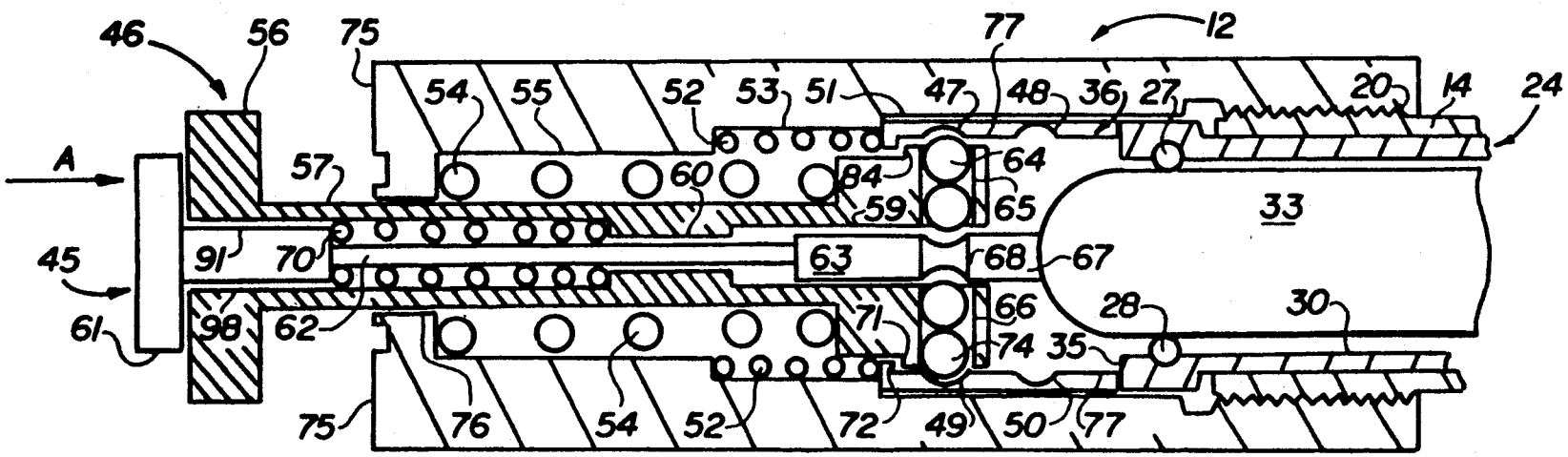
FIG. 3 is a side section view of the rear portion of the weapon of FIG. 1 illustrating the mode of operation thereof.

To initiate the firing of the weapon of FIG. 1, the user depresses with his fingers head 61 in the direction of arrow A. Head 61 is depressed until head 61 contacts head 56 and is in the position illustrated in FIG. 3. As soon as toe 63 is in the position illustrated in FIG. 3, the force of spring 54 acting against foot 58 of housing 46 causes dimple 47 to generate an inward displacement force on the sphere 64 contacting dimple 47. The force generated on sphere 64 by dimple 47 causes the spheres 64 to slide inwardly through aperture 65 such that spheres 64 remain in contact and one of spheres 64 seats in groove 68. Dimple 49 generates a similar displacement force on the sphere 74 contacting dimple 49 to cause spheres 74 to slide inwardly through aperture 66 such that spheres 74 remain in contact and one of spheres 74 seats in groove 68. As soon as spheres 64, 74 seat in groove 68, foot 58 is free to be urged in the direction of arrow A toward stationary container 33. In FIG. 2 and 3, the position of container 33 is the same as the position of container 33 in FIG. 6.

After spheres 64, 74 seat in groove 68 to free up foot 58 for displacement in the direction of arrow A, compressed spring 70 resists the displacement of toe 63 and foot 58 in the direction of arrow A. Spring 54 is, however, substantially stronger than spring 70 and readily overcomes any resistance offered by spring 70. As a result, when spring 54 moves foot 58 in the direction of arrow A, spring 54 also simultaneously moves plunger 45 in the direction of arrow A because spheres 64, 74 interlock foot 58 and toe 63.

Figure 4:
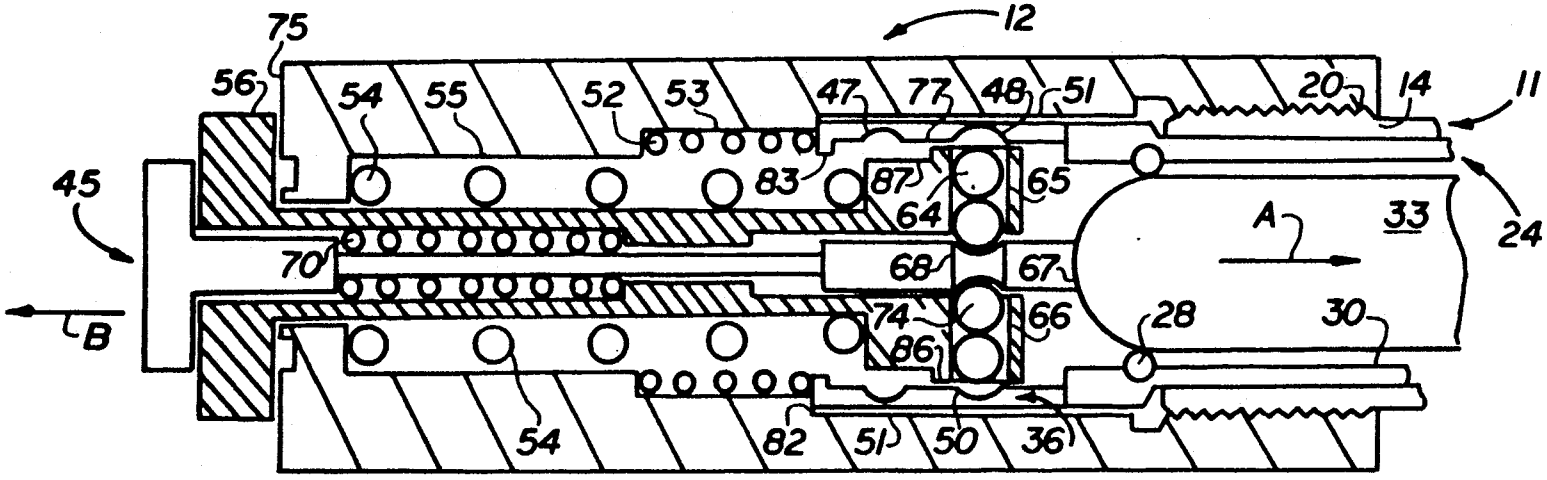
FIG. 4 is a side section view of the rear portion of the weapon of FIG. 1 further illustrating the mode of operation thereof.

After spheres 64, 74 seat in groove 68 to free up foot 58 for displacement in the direction of arrow A, spring 54 displaces foot 58 and toe 63 in the direction of arrow A until head 56 contacts circular end surface 75 in the manner shown in FIG. 4. When spring 54 moves foot 58 and toe 63 in the direction of arrow A from the position shown in FIG. 3 to the position shown in FIG. 4, the circular end surface 67 of toe 63 contacts container 33 and moves container 33 from the position shown in FIG. 6 in the direction of arrow A toward the fixed puncture point 32 to drive point 32 through the seal in the neck of container 33.

As soon as foot 58, head 56 and toe 63 reach the position illustrated in FIG. 4, the contact of head 56 against end surface 75 prevents foot 58 from moving any further in the direction of arrow A. Further, the contact of head 56 against end surface 75 prevents end surface 67 from moving any further in the direction of arrow A and, importantly, permits spring 70 to displace plunger 45 in the direction of arrow B. Plunger 45 can move in the direction of arrow B because spring 70 causes groove 68 to generate displacement forces on the spheres 64, 74 in groove 68. These displacement forces cause the sphere pair 64 to slide outwardly through radial aperture 65 such that the sphere pair 64 remain in contact with one another and such that one of the spheres 64 seats in dimple 48, i.e. the sphere 64 seated in groove 68 moves out of groove 68 toward dimple 48. Similarly, the displacement forces generated on sphere pair 74 by groove 68 cause the sphere pair 74 to slide outwardly through radial aperture 66 such that the sphere pair 74 remain in contact with one another and such that one of the spheres 74 seats in dimple 50, i.e., the ball 74 seated in groove 68 moves out of groove 68 toward dimple 50. As soon as ball pairs 64, 74 are outwardly displaced and a ball 64 seats in dimple 48 and a ball 74 seats in dimple 50, then there is not a ball 64, 74 contacting groove 68 and toe 63 is free to be displaced in the direction of arrow B by spring 70.

FIG. 5 illustrates the trigger mechanism of FIG. 4 after the plunger 45 has been displaced in the direction of arrow B by spring 70. The displacement of plunger 45 in the direction of arrow B is halted when toe 63 contacts step bore 60 of housing 46. When plunger 45 is displaced in the direction of arrow B, this permits the pressurized air in container 33 to act against point 32 and, in conjunction with compressed spring 99, to move container 33 in the direction of arrow B to the position shown in FIG. 5. Spring 99 forces container in the direction of arrow B. The position of container 33 in FIG. 5 is about the same as the position of container 33 in FIG. 6. When container 33 moves to the position shown in FIG. 5, the pressurized gas escapes from container 33, moves through apertures 31 (FIG. 6) into passageway 29, displaces check member 41, and causes diaphragm 23 to rupture in the manner earlier described. When diaphragm 23 ruptures, the pressurized gas forces member 41 and projectile 42 out the open end 19 of barrel 11.

After the weapon 10 has been fired, and the firing mechanism is in the configuration shown in FIG. 5, the inner threaded surface 20 of casing 12 is unthreaded from the externally threaded end 14 of barrel 11. When casing 12 is unthreaded from barrel 11, the shuttle member 36, plunger 45, and housing 46 remain in the configuration shown in FIG. 5. After casing 12 is removing from barrel 11, plunger 45 is displaced in the direction of arrow A toward circular end surface 75. Plunger 45 is so displaced until head 61 contacts head 56. When head 61 contacts head 56, radial apertures 65 and 66 are centered above groove 68 and spring 52 generates a force on member 36 which in turn causes each dimple 48 and 50 to generate an inward displacement force on its respective sphere 64, 74. The inward displacement force generated by dimple 48 causes the sphere pair 64 to slide inwardly along aperture 65 such that spheres 64 remain in contact and such that a sphere 64 seats in groove 68. The inward displacement force generated by dimple 50 causes the sphere pair 74 to slide inwardly along aperture 66 such that spheres 74 remain in contact and such that a sphere 74 seats in groove 68. As soon as spheres 64, 74 seat in groove 68, member 36 is freed up and compressed spring 52 displaces member 36 in a direction away from end surface 75. Member 36 is moved away from surface 75 until lip 83 contacts lip 84 of foot 58. When lip 83 contacts lip 84 the movement of member 36 stops, and dimple 47 is centered over aperture 65 and dimple 49 is centered over aperture 66. The pressure which was applied to plunger 45 to displace head 45 toward head 56 is then released, which permits spring 70 to act to move head away from head 56 and permits groove 38 to generate outward displacement forces on balls 64, 74 to move the ball pairs 64, 74 to the position shown in FIG. 2 and to move plunger 45 and toe 63 thereof to the position shown in FIG. 2. When casing 12 is threaded back onto end 14 of barrel 11, end 35 (FIG. 3) of shot tube 24 contacts member 36 and moves member 36 toward end surface 75. When end 35 moves member 36 toward surface 75, spring 52 is compressed and, since balls 64 and 74 "interlock" member 36 and housing 46, housing 46 is simultaneously moved in the same direction as member 36 so that, once casing 12 is fully threaded onto end 14, member 36 and housing 46 and plunger 45 take on the configuration shown in FIG. 2 and the trigger mechanism is again cocked and ready to be fired.

A particular advantage of the weapon of the invention is that the barrel velocity of projectile 42 can be varied by altering the thickness and the shear strength of base 39 of diaphragm member 23. The base 39 at its peripheral thinnest dimension along floor 92 is presently preferably about twenty thousandths of an inch thick to within a tolerance of plus or minus three thousandths of inch. The base 39 is preferably fabricated from a DELRIN plastic material. The thicknesses, shape and dimension, and materials used to fabricate diaphragm member 23 can, as appreciated by those skilled in the art, vary widely. While in FIG. 6 the diaphragm member 23 is shown placed between projectile 42 and the open end 19 of barrel 11, weapons can be designed in which member 23 is placed intermediate projectile 42 and container 33.

O-ring 28 prevents pressurized gas from escaping in the direction of arrow B intermediate O-ring 28 and container 33. Various other O-ring configurations or other sealing mechanisms can be utilized to insure that pressurized gas which escapes from container 33 moves in the direction of arrow A through apertures 31 and out through barrel 11.

While the firing mechanism illustrated in FIGS. 2 to 6 is presently preferred, a wide variety of other firing mechanisms can be utilized in a weapon having a shearable diaphragm in accordance with the invention. Sources of pressurized gas other than an "on-board" pressurized gas container may be utilized. For example, the container which provides pressurized gas may comprise a compressed air pump attached to the weapon to generate the pressure necessary to fire the weapon.

In FIG. 6, passageway 29 comprises the axially extending passageway which houses projectile 42. In FIG. 2, passageways 30, 51, 53, and 55 collectively define the passageway which houses container 33 and the associated firing mechanism of the weapon 10.

If desired, aperture 65 and spheres 64 can be shaped and dimensioned so that only one sphere or more than two spheres 64 are utilized in aperture 65 (or in aperture 66).

Dimples 47 and 49 can be replaced by a circular retaining groove which is formed in surface 77 and circumscribes foot 58. Similarly, dimples 48 and 50 can be replaced by a circular retaining groove which is formed in surface 77 and circumscribes foot 58. Such circular retaining grooves would be shaped to perform the functions performed by dimples 47 and 50 when spheres 64, 74 are radially displaced into and out of dimples 47 to 50. The circular retaining grooves would have a center line corresponding to the centerline of tube 24, cylindrical casing 12, and barrel 11 in FIG. 6. An advantage of using circular retaining grooves is that when foot 58 is in the position shown in FIG. 3 or the position shown in FIG. 4, apertures 65, 66 will be positioned over one of the retaining grooves regardless of any rotation of foot 58 about the longitudinal axis and centerline of casing 12, tube 24 or barrel 11 in FIGS. 3 and 4. In contrast, when dimples 47 to 50 are utilized, foot 58 must be positioned so that apertures 65 and 66 are, in FIGS. 3 and 4, each positioned over one of dimples 47 to 50. In the embodiment of the invention shown in FIGS. 3 and 4, it is preferred that housing 46 be keyed in casing 12.

The inner diameter of cylindrical end 95 of tube 24 equals the inner diameter of passageway 29 of tube 24. The outer diameter of end 95 is less than the outer diameter of passageway 29 of tube 24. Rigid cylindrical end 95 serves an important function in that end 95 prevents the wall 38 of member 23 from collapsing inwardly toward center plateau 40 when pressurized gas released from container 33 causes projectile 42 to be pressed against base 39 to shear floor 92 of member 23. Maintaining wall 38 in the position shown in FIG. 6 when projectile 42 is being pressed against base 29 promotes the clean shearing of base 39 along a circular line which is concentric to wall 38 and barrel 11.

In FIGS. 2 to 5, sphere pair 64 (or 74) can be replaced by the solid "capsule" ball means 100 illustrated in FIG. 9. The height, indicated by arrows L, of ball means 100 equals the height of the sphere pair 64 stacked in aperture 65. The diameter of each of the hemispherical ends 101 and 102 equals the diameter of each sphere 64. The diameter of the cylindrical mid-section 103 of means 99 equals the diameter of each of spheres 64. Means 99 moves radially in aperture 65 and functions in the same manner as spheres 64.

We claim:

1. In a gas powered weapon system, (a) a case defining first and second axially extending passages, said first passage being in fluid communication with said second passage and having an open end;

(b) a projectile located in said first passage to be slidably urged along said first passage and out said open end;

(c) a dischargeable pressurized gas container located in said second passage;

(d) a transversely extending shearable member located in one of said first and second passages intermediate said gas container and said open end, said shearable member including (i) a central portion, and (ii) a peripheral portion at least partially circumscribing said central portion, said central portion having a thickness greater than said peripheral portion to promote shearing of said shearable member through said peripheral portion; and, (e) means for releasing said pressurized gas from said gas container to increase the pressure inside said case, cause said member to shear through said peripheral portion of said shearable member, and cause at least a portion of said gas to move from said second passage to said first passage and propel said projectile through said first passage and out said open end.

2. The system of claim 1, wherein said peripheral portion is shaped and dimensioned such that said shearable member shears through said peripheral portion along a line generally concentric to said one of said first and second passages.

3. In a gas powered weapon system, (a) a case defining first and second axially extending passages, said first passage being in fluid communication with said second passage and having an open end;

(b) a projectile located in said first passage to be slidably urged along said first passage and out said open end;

(c) a dischargeable pressurized gas container located in said second passage;

(d) a transversely extending shearable member located in one of said first and second passages intermediate said gas container and said open end; and, (e) means for releasing said pressurized gas from said gas container to increase the pressure inside said case, cause said member to shear, and cause at least a portion of said gas to move from said second passage to said first passage and propel said projectile through said first passage and out said open end, said means for releasing said pressurized gas including means for displacing said gas container, said displacing means including (i) a housing positioned in said second passage and having a first axial passage extending through said housing, a second radial passage extending through said housing, and ball means slidably positioned in said radial passage;

(ii) spring means positioned in said second radially extending passage to urge said housing toward said gas container;

(iii) control means positioned in said second radially extending passage and having first and second spaced apart grooves each for receiving in part said ball means; and, (iv) plunger means including a groove for receiving in part said ball means and slidably positioned in said first axial passage of said housing for movement between at least two operative positions, a first position with said plunger means urging said ball means into contact with said first groove of said control means, and a second operative position with said plunger means axially displaced from said first position to permit said ball means to move radially out of contact with said first groove of said control means and into contact with said groove in said plunger means, and said spring means to displace said housing and said plunger means toward said gas container such that at least one of said plunger means and said housing contacts and axially displaces said gas container.

4. In a gas powered weapon system, (a) a case defining first and second axially extending passages, said first passage being in fluid communication with said second passage and having an open end;

(b) a projectile slidably located in said first passage to be slidably urged along said first passage and out said open end;

(c) a dischargeable pressurized gas container located in said second passage;

(d) means for releasing said pressurized gas from said gas container to increase the pressure inside said case and cause at least a portion of said gas to move from said second passage to said first passage and slidably propel said projectile through said first passage and out said open end, said releasing means including (i) a housing positioned in said second passage and having a radial passage extending through said housing, and ball means slidably positioned in said radial passage, (ii) spring means positioned in said second passage to urge said housing toward said gas container, (iii) control means positioned in said second passage and having first and second spaced apart grooves each for receiving in part said ball means, and (iv) plunger means including a groove for receiving in part said ball means, said plunger means moveable between at least two operative positions, a first position with said plunger means urging said ball means into contact with said first groove of said control means, and a second operative position with said plunger means axially displaced from said first position to permit said ball means to move radially out of contact with said first groove of said control means and into contact with said groove in said plunger means, and said spring means to displace said housing toward said gas container.

* * * * *